United States Patent [19]

Lyons et al.

[11] 4,328,839

[45] May 11, 1982

[54] FLEXIBLE DRILL PIPE

[75] Inventors: William C. Lyons; Scot L. Scurlock, both of Santa Fe, N. Mex.

[73] Assignee: Drilling Development, Inc., Houston, Tex.

[21] Appl. No.: 188,617

[22] Filed: Sep. 19, 1980

[51] Int. Cl.[3] ..... D03D 21/00

[52] U.S. Cl. ..... 138/120; 138/155; 175/320; 285/330; 403/339

[58] Field of Search ..... 138/155, 100, 120, 166; 285/330; 64/15, 2 R; 175/320; 403/339, 340, 381, 364

[56] References Cited

U.S. PATENT DOCUMENTS

| | | | |
|---|---|---|---|
| 2,382,933 | 8/1945 | Zublin | 175/61 |
| 2,515,366 | 7/1950 | Zublin | 138/120 |
| 2,585,207 | 2/1952 | Zublin | 175/75 |
| 2,687,282 | 8/1954 | Sanders | 175/320 |
| 2,694,549 | 11/1954 | James | 175/82 |
| 3,160,218 | 12/1964 | Crake | 175/75 X |
| 3,903,974 | 9/1975 | Cullen | 175/61 X |
| 4,067,404 | 1/1978 | Crase | 175/75 |

*Primary Examiner*—Robert I. Smith

*Attorney, Agent, or Firm*—Vinson & Elkins

[57] ABSTRACT

A flexible pipe adapted for connection in a drill string, having sufficient wall thickness in order to withstand forces imposed by drilling a well. The flexible pipe has a plurality of improved, essentially circumferential cuts, each cut being through the wall thickness of the pipe. The cuts provide a pipe having a plurality of dovetail teeth and complimentary recesses on each end of the intermediate segments. The teeth on one segment are positioned in the recesses and interlocking with the teeth of the adjacent segment. Each side of each tooth consists of two reversed, intersecting semicircles. The tooth and recess interlock has sufficient clearance to form a joint which has limited relative movement in any direction between the segments.

7 Claims, 3 Drawing Figures

FLEXIBLE DRILL PIPE

BACKGROUND OF THE INVENTION

1. Field of the Invention

The present invention relates to a segmented, flexible drill pipe having an improved dovetail configuration for the interlocking segments.

2. Prior Art

In drilling deviated well bores it is necessary to use drill pipe that can bend through the curve of deviation from the vertical. There have been a number of proposals for segmenting regular drill pipe to make the pipe bend without permanently distorting the pipe. For example, U.S. Pat. No. 2,515,366, issued to John A. Zublin, teaches forming a plurality of generally circumferential slots, each cut through the wall of a tubular drill pipe, so that the pipe is divided into a plurality of sections.

While the slots are generally circumferential, they deviate from a true circumference to form a plurality of interengaging and loosely interlocking teeth having a dovetail configuration. The tops and sides of each dovetail, in the Zublin patent, are each relatively straight. This is evident in viewing the drawings accompanying the patent. Further, Zublin's dovetail cuts were vertically true and straight in line with the next.

It has been found that the straight sides of the Zublin dovetail cut allow excessive distortion in bending the drill pipe and often causes damage to the cut if excessive force is applied at the bend. Sometimes, on heavy duty rotation of the drill pipe, the pipe will fail at a particular stress weakened cut. This has been attributed to the vertical alignment, as well as the straight sides of the cuts.

Therefore, it is an object of the present invention to provide an improved dovetail cut for flexible drill pipe.

It is a further object to provide increased rotational strength in the drill pipe having the new dovetail cut.

Another object is to provide improved bending of the flexible drill pipe while retaining integrity of the dovetail teeth.

Yet another object is to provide improved rotational strength of the drill pipe by providing a left hand offset to each succeeding dovetail cut.

SUMMARY OF THE INVENTION

A flexible pipe comprising an elongated tubular member subdivided into a plurality of segments of rigid pipe of substantial wall thickness in end to end relationship with a plurality of dovetail teeth and complimentary recesses on each end of the intermediate segments, the teeth of one segment being positioned in the recesses and interlocking the teeth of the adjacent segment with sufficient clearance to form a joint permitting limited relative movement in any direction between the segments, said teeth being essentially bell shaped, each tooth having a substantially flat end portion lying along the circumferential direction of the pipe, with each side of each tooth consisting of two reversed, intersecting semicircles.

The above and other objects and features of the invention will be apparent to those skilled in the art after a consideration of the following detailed description taken in conjunction with the accompanying drawings in which a preferred embodiment of the invention is shown.

DESCRIPTION OF THE PREFERRED EMBODIMENTS

The flexible drill pipe of the present invention is particularly useful in aiding in the drilling of lateral bores deviating from a vertical bore hole. The particular dovetail cut, described hereinafter, is well adapted for resisting the compressive, bending and torque stresses encountered in drilling bore holes.

In drilling lateral bores, from a vertical bore hole, the drill pipe must be capable of bending through the radius of an arc to enter the lateral bore hole and then resume an essentially straight configuration for subsequent straight drilling. In operation, the drill pipe string consists of both regular drill pipe and similar flexible drill pipe.

Reference should be made to our copending application U.S. Ser. No. 188,728, filed 9/19/80, which is directed to a drill guide which is normally used in conjunction with the flexible pipe of the present invention. In that application, the flexible drill pipe is referred to as a drive pipe. As taught in the above referred to application, a plurality of flexible drill pipes would be used to make up a portion of the drill string, with at least one of the flexible drill pipes being received and housed within the bore of the drill guide. The drill pipe terminating in the drill guide carries a drill bit for cutting the bore hole. The drill guide is adapted for guiding the direction of drilling and does not rotate with the flexible drill pipe of the present invention.

Figure 1:
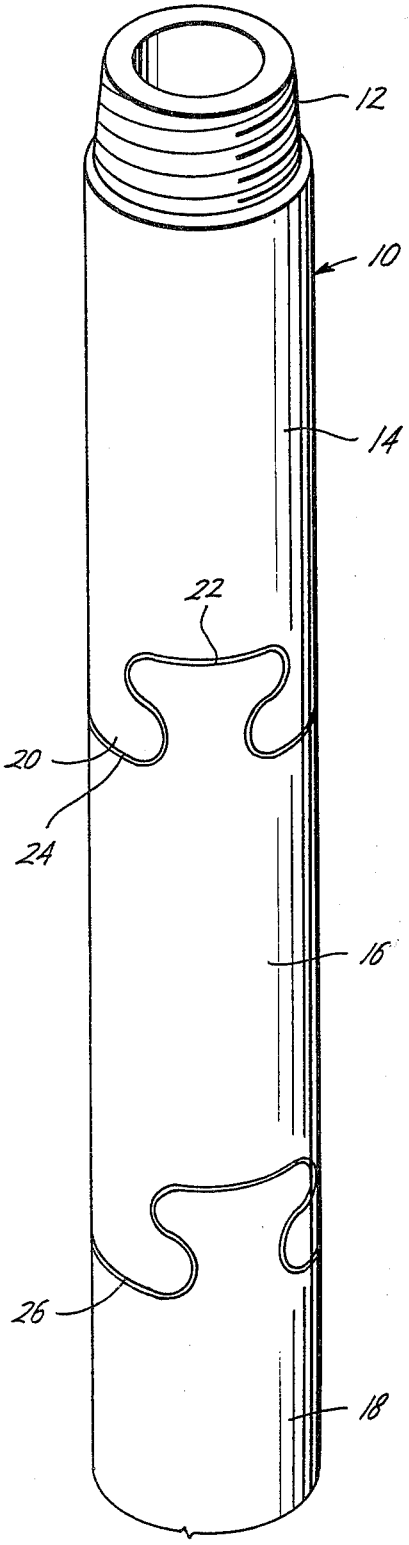
FIG. 1 is a perspective view of a portion of a flexible drill pipe segmented using the improved dovetail configuration of the present invention.

Referring now to FIG. 1, there is illustrated perspectively, a portion of a flexible drill pipe 10 comprising an elongated tubular member subdivided into a plurality of segments 14, 16 and 18. The drill pipe 10 is preferably of rigid construction having a substantial wall thickness to withstand the compressive, bending and torque stresses encountered in drilling bore holes.

The segments 14, 16 and 18 are representative of the drill pipe 10 which has means 12 on each end thereof for connection with another drill pipe. The connection means 12 shown in FIG. 1 is a threaded portion of the drill pipe 10. The threaded ends of the drill pipe 10, such as the pin end segment 14, are interconnected to a plurality of intermediate segments, such as segments 16, which is representative of all other intermediate segments, and which are arranged in end to end relationship.

Each end of each intermediate segment 16 has a plurality of dovetail teeth 22 and **22*a*, and complimentary recesses 24 and 24*a*. The teeth 22*a* of one segment 16 being positioned in the recesses 26 and interlocking the teeth 27 of the adjacent segment 18 with sufficient clearance to form a joint permitting relative movement in any direction between the segments 16 and 18**.

The width of the generally circumferential cut, forming the teeth 22 and recesses 24 configuration, is preferably sufficient to permit the segments of the flexible drill pipe 10 to have radial and axial relative movement with each other. As torque is applied to the drill pipe 10 in drilling one side of the dovetail teeth 22 of one section 16 will move into contact with the side of the teeth 20 received in the complimentary recesses 24.

Preferably, the flexible drill pipe 10 of the invention is manufactured by cutting through the wall thickness of a drill pipe. While other methods of manufacture may be available in the industry, it has been found that by using a commercially available drill pipe as the basic tubular member, the desired end product is achieved. This also provides a tubular member having sufficient wall thickness to give the teeth 22 and 20 the strength to resist the stresses that will be placed on them in drilling.

The present invention particularly resides in the novel configuration of the means for interlocking the adjacent segments 16 and 18 of the drill pipe 10. The teeth 22 and recesses 24, are formed by a generally circumferential cut through the wall thickness of the pipe 10.

Figure 3:
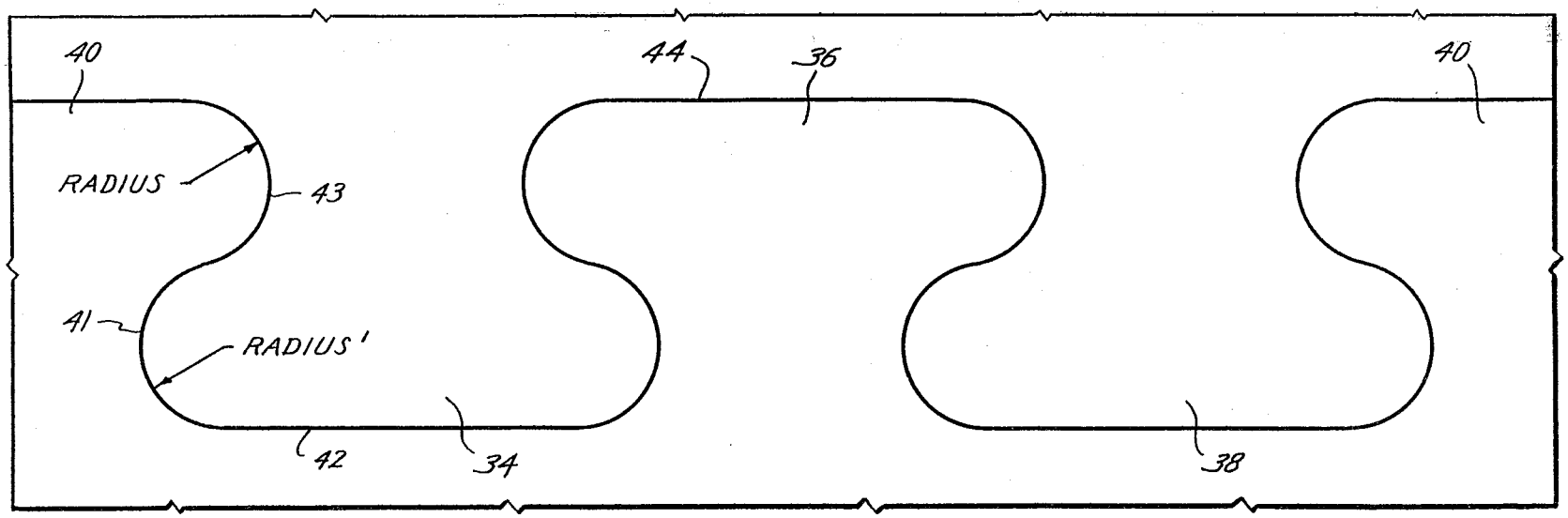
FIG. 3 is a laid section of a portion of flexible drill pipe, in template form, showing the interlocking dovetail configuration of adjacent segments of the pipe.

Of course, the cut deviates from a true circumference of the drill pipe, to form teeth 34, 36, 38 and 40, as illustrated in FIG. 3, and complimentary recesses. Each of the teeth 34, 36, 38 and 40 is essentially bell shaped and has a substantially flat end portion 42 and 44 lying along the circumferential direction of the drill pipe 10.

Each side of each tooth 34 and 40 comprises two reversed, intersecting semicircles 41 and 43 having essentially equal radii. It is not absolutely necessary that the intersecting semicircles 41 and 43 have equal radii. However, in the preferred embodiment of the invention the radii are essentially equal.

When the ends of the template of FIG. 3 are joined, there is formed a tubular section representative of the generally circumferential interlocking connection of the two adjacent segments. In the preferred embodiment of the invention each end of each segment of the flexible drill pipe has two teeth 34 and 38 and two complimentary recesses separating the teeth 34 and 38 from each other. It has been found that this two teeth configuration, with the generally bell shaped configuration of the teeth, permits each junction of segments to act like a universal joint. This provides greatly improved handling of the flexible drill pipe in entering the deviated lateral bore, and provides greater working force in drilling with the flexible drill pipe of the present invention.

An additional part of the invention resides in the discovery that it is beneficial to have the teeth 22, formed on one end of a segment 16 of flexible drill pipe 10, offset in either direction, with a counterclockwise rotation from the complimentary recesses 24*a* on the opposite end of the drill pipe segment 16 being preferred.

Figure 2:
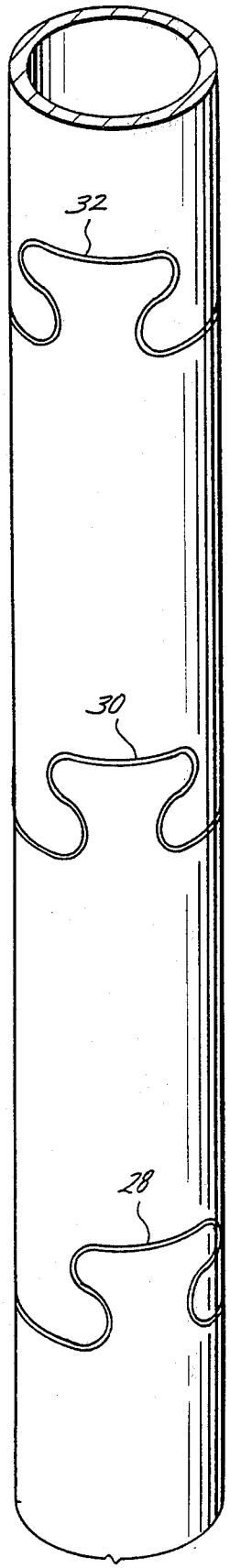
FIG. 2 is a perspective view of a portion of the flexible drill pipe of the present invention, illustrating the counterclockwise offset of each succeeding cut.

This is particularly illustrated in FIG. 2, where there is shown four interconnections of segments of the flexible drill pipe 10. It is seen that the interconnections of teeth and recesses 28, 30 and 32 are offset, in counterclockwise rotation, one from the preceeding one.

While this offset is not essential in utilizing the novel bell shaped dovetail cut, it has been found that such a combination in a flexible drill pipe 10 is extremely useful. Further, the dovetail, bell shaped cut and counterclockwise offset combine in a synergistic manner to provide a drill pipe having greatly improved flexibility and a greater resistance to compressive, bending and torque stresses encountered in drilling.

What is claimed is:

1. A flexible pipe comprising an elongated tubular member subdivided into a plurality of segments of rigid pipe of substantial wall thickness in end to end relationship with a plurality of interlocking teeth and complimentary recesses on each end of the intermediate segments, the teeth of one segment being positioned in the recesses of, and interlocking the teeth of, the adjacent segment with sufficient clearance to form a joint permitting limited relative movement in any direction between the segments, said teeth being generally bell-shaped, each tooth having a substantially flat end portion lying along the circumferential direction of the pipe, with each side of each tooth comprising two reversed, intersecting semicircles, each of said semicircles having a diameter substantially less than the length of said tooth and substantially less than the width of said substantially flat end portion.

2. The flexible pipe of claim 1, wherein there are two teeth and two complimentary recesses on each end of the intermediate segments of said pipe.

3. The flexible pipe of claim 1, wherein each plurality of teeth formed on one end of each segment of pipe is offset in counterclockwise rotation from the plurality of complimentary recesses on the opposite end of the pipe segment.

4. The flexible pipe of claim 3, wherein there are two teeth and two complimentary recesses on each end of the intermediate segments of said pipe.

5. A flexible pipe comprising an elongated tubular member, adapted for connection in a drill string, having sufficient wall thickness in order to withstand forces imposed by drilling a well, said tubular member being subdivided into a plurality of segments, of approximately equal length, with two interlocking teeth and complimentary recesses on each end of the intermediate segments, the teeth of one segment being positioned in the recesses of, and interlocking the teeth of, the adjacent segment with sufficient clearance to form a joint permitting limited radial and axial movement between the segments, said teeth being generally bell-shaped, each tooth having a substantially flat end portion lying along the circumferential direction of the pipe, with each side of each tooth lying essentially in the axial plane of the pipe and consisting of two reversed, intersecting semicircles having approximately equal radii.

6. The flexible pipe of claim 5, wherein each pair of teeth formed on one end of each segment of pipe is offset, in counterclockwise rotation, from the pair of complimentary recesses on the opposite end of pipe segment.

7. The flexible pipe of claim 1 wherein the intersecting semicircles forming each side of each tooth have approximately equal radii.

* * * * *